US008006440B2

(12) United States Patent
Thomas et al.

(10) Patent No.: US 8,006,440 B2
(45) Date of Patent: Aug. 30, 2011

(54) HEADWALL HAVING MOVABLE COVER

(75) Inventors: Jody A. Thomas, Batesville, IN (US); Dallas J. Suding, Batesville, IN (US); Steven R. Westerfeld, Holton, IN (US); Gilbert R. Walker, Versailles, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 532 days.

(21) Appl. No.: 12/114,028

(22) Filed: May 2, 2008

(65) Prior Publication Data

US 2008/0276551 A1 Nov. 13, 2008

Related U.S. Application Data

(60) Provisional application No. 60/928,050, filed on May 7, 2007.

(51) Int. Cl.
*B66B 9/00* (2006.01)

(52) U.S. Cl. ..... 52/29; 52/220.1; 312/319.8; 312/322; 312/325; 248/278.1

(58) Field of Classification Search ..... 52/36.4, 52/36.1, 29, 220.1; 312/319.8, 322, 325; 248/278.1, 282.1, 289.11
See application file for complete search history.

(56) References Cited

U.S. PATENT DOCUMENTS

| | | | | |
|---|---|---|---|---|
| 1,287,699 | A | 12/1918 | Kinsman | |
| 1,606,870 | A | 11/1926 | Corwin | |
| 2,265,421 | A * | 12/1941 | Donnelly | 99/443 R |
| 2,773,728 | A | 12/1956 | La Barre | |
| 3,131,512 | A | 5/1964 | MacLeod, Jr. | |
| 3,200,244 | A | 8/1965 | Meyer | |
| 3,462,892 | A | 8/1969 | Meyer | |
| 3,490,727 | A * | 1/1970 | Miller | 248/284.1 |
| 3,491,486 | A | 1/1970 | Caruth | |
| 3,567,842 | A | 3/1971 | Meyer | |
| 3,667,714 | A * | 6/1972 | Ziaylek, Jr. | 248/284.1 |
| 3,692,920 | A | 9/1972 | Santarelli | |
| 3,699,235 | A | 10/1972 | Wasson et al. | |
| 3,836,937 | A | 9/1974 | Donato | |
| 3,931,452 | A | 1/1976 | Nilsson | |

(Continued)

FOREIGN PATENT DOCUMENTS

CA 510857 3/1955

OTHER PUBLICATIONS

"Picture the Freedom to Create a Healing Environment", Gallery Wall, Hill-Rom, 2001, (4 pages).

*Primary Examiner* — Brian E Glessner
*Assistant Examiner* — Joshua Ihezie
(74) *Attorney, Agent, or Firm* — Barnes & Thornburg LLP

(57) ABSTRACT

An apparatus is provided for coupling to a wall in a healthcare facility, such as a hospital. The apparatus comprises a housing configured to support at least one service outlet, a cover and a linkage for mounting the cover to the housing for pivoting movement between a closed position in which the cover blocks access to the at least one service outlet and an open position in which the cover allows access to the at least one service outlet. The cover remains substantially parallel to the wall as it travels between the closed and open positions. The cover may comprise a wall accessory, such as a picture frame.

20 Claims, 16 Drawing Sheets

U.S. PATENT DOCUMENTS 3,994,474 A * 11/1976 Finkbeiner ..... 254/88
4,017,137 A 4/1977 Parks
4,076,351 A * 2/1978 Wyant ..... 312/247
4,135,775 A 1/1979 Driscoll
4,266,747 A * 5/1981 Souder et al. ..... 248/280.11
4,277,123 A 7/1981 Haworth et al.
D261,804 S 11/1981 Foster et al.
4,338,485 A 7/1982 Fullenkamp et al.
4,475,322 A 10/1984 Russo et al.
4,559,410 A 12/1985 Hostetter
4,642,418 A 2/1987 Menchetti
4,646,211 A 2/1987 Gallant et al.
4,753,055 A 6/1988 Durham, Jr.
4,821,470 A * 4/1989 Kappers et al. ..... 52/220.1
4,843,978 A * 7/1989 Schmidt et al. ..... 108/138
4,876,830 A * 10/1989 Wate ..... 52/29
5,058,846 A * 10/1991 Close ..... 248/284.1
5,060,425 A 10/1991 Kappers et al.
5,224,677 A * 7/1993 Close ..... 248/292.11
5,323,565 A 6/1994 Kappers et al.
5,448,859 A 9/1995 Walker et al.
5,618,090 A 4/1997 Montague et al.
5,653,064 A 8/1997 Kappers et al.
5,715,633 A * 2/1998 Raz et al. ..... 52/220.7
5,756,933 A 5/1998 Pitchford et al.
5,758,782 A * 6/1998 Rupert ..... 211/99
5,878,536 A 3/1999 Demmitt et al.
5,890,326 A 4/1999 Gallant et al.
6,101,773 A * 8/2000 Chau et al. ..... 52/220.7
6,145,253 A 11/2000 Gallant et al.
6,405,491 B1 6/2002 Gallant
6,442,799 B1 * 9/2002 Duarte et al. ..... 16/277
6,764,125 B2 * 7/2004 Bacon ..... 296/100.08
6,779,856 B2 * 8/2004 Hornberger et al. ..... 312/295
6,895,715 B2 5/2005 Gallant et al.
7,040,057 B2 5/2006 Gallant et al.
7,174,678 B2 * 2/2007 Gallant ..... 52/36.1
7,204,714 B2 4/2007 Walker et al.
7,219,472 B2 5/2007 Gallant et al.
7,392,621 B2 7/2008 Gallant et al.
7,448,703 B2 * 11/2008 Kung ..... 312/327
2004/0040213 A1 * 3/2004 McCarthy-Garland et al. ..... 49/341
2004/0245419 A1 * 12/2004 Sweere et al. ..... 248/276.1
2008/0246254 A1 * 10/2008 Tyerman ..... 280/477

* cited by examiner

HEADWALL HAVING MOVABLE COVER

CROSS REFERENCE TO RELATED APPLICATION

This application claims the benefit of U.S. Provisional Patent Application Ser. No. 60/928,050, filed on May 7, 2007, and entitled "HEADWALL HAVING MOVABLE COVER," which is hereby incorporated by reference herein.

BACKGROUND OF THE INVENTION

The present disclosure relates generally to a headwall for providing gas, vacuum, electrical and other services to patient care areas in a healthcare facility, such as a hospital.

In the patient care areas of most healthcare facilities, it is necessary that services such as electrical power, vacuum, air and medical gases be readily accessible. However, the appearance of the outlets for such services in the patient care areas is unattractive and, to some patients, alarming. An arrangement for concealing the service outlets, when not in use, is disclosed in U.S. Pat. No. 5,448,859.

SUMMARY OF THE INVENTION

The present invention comprises an apparatus having one or more of the features recited in the claims or one or more of the following features, which alone or in any combination may comprise patentable subject matter:

An apparatus for coupling to a wall in a healthcare facility is provided. The apparatus may comprise a housing configured to support at least one service outlet, a cover and a linkage for mounting the cover to the housing for pivoting movement between a closed position in which the cover blocks access to the at least one service outlet and a open position in which the cover allows access to the at least one service outlet. The cover may remain substantially parallel to the wall as it travels between the closed and open positions. The cover may comprise a wall accessory, such as a picture frame, a decoration, etc. The at least one service outlet may comprise a plurality of service outlets. Examples of service outlets may include, but are not limited to, the following: electrical outlets, emergency power outlets, low voltage outlets, medical gas outlets (such as oxygen, nitrogen, etc.), air outlets, vacuum outlets, data ports, communication ports, and the like.

The linkage may comprise at least one parallelogram linkage. The at least one parallelogram linkage may include a frame bracket coupled to the housing, a cover bracket coupled to the cover, and upper and lower support arms. Each support arm may have a first end coupled to the frame bracket for pivoting movement about a first laterally-extending axis and a second end coupled to the cover bracket for pivoting movement about a second laterally-extending axis. In some embodiments, the at least one parallelogram linkage may comprise a pair of laterally-spaced parallelogram linkages. In some embodiments, the frame and cover brackets may be omitted. Each parallelogram linkage may further comprise a gas spring that includes a cylinder and a piston rod that retracts into and extends out of the cylinder. The cylinder may be coupled to one of the upper support arm and the frame bracket of the associated linkage and the piston rod may be coupled to the other of the upper support arm and the frame bracket of the associated linkage.

Each frame bracket may include upper and lower flanges that extend forwardly toward the cover. Each cover bracket may include upper and lower flanges that extend rearwardly toward the housing. The first end of each upper support arm may be pivotably coupled to the upper flange of the associated frame bracket and the second end of each upper support arm may be pivotably coupled to the upper flange of the associated cover bracket. The first end of each lower support arm may be pivotably coupled to the lower flange of the associated frame bracket and the second end of each lower support arm may be pivotably coupled to the lower flange of the associated cover bracket.

The housing may have an upper portion and a lower portion. The upper portion may support the frame brackets of the parallelogram linkages. The lower portion may define a lower compartment in which the service outlets may be located. The upper portion may define an upper compartment through which service lines may be routed to the associated service outlets located in the lower compartment. The housing may be received in a recess in the wall such that a front surface of the housing is substantially flush with a front surface of the wall.

The cover may define a footprint when projected toward the wall. The housing may lie inside the footprint of the cover when the cover is the closed position. The cover may comprise a wall accessory, such as a picture frame, a decoration, etc. The open position may be higher than the closed position and the wall structure may include a detent for retaining the cover in the higher open position. In other embodiments, the closed position may be higher than the open position and the wall structure may include a detent for retaining the cover in the higher closed position.

In some embodiments, each support arm of each parallelogram linkage may have a first end coupled to the housing for pivoting movement about a longitudinally-extending first axis and a second end coupled to the cover for pivoting movement about a longitudinally-extending second axis. The first end of each support arm may have a collar that extends rearwardly toward the housing and that includes a bore for receiving a pivot post that extends forwardly from the housing so that the support arm is rotatable about a longitudinal axis of the associated pivot post. Likewise, the second end of each support arm may have a collar that extends forwardly toward the cover and that includes a bore for receiving a pivot post that extends rearwardly from the cover so that the support arm is rotatable about a longitudinal axis of the associated pivot post. Each collar may be longitudinally slidable relative to the associated pivot post.

A rearwardly-facing annular surface of each collar attached to the first end of each support arm may have a pair of notches that correspond to the closed and open positions of the cover. Likewise, a forwardly-facing annular surface of each collar attached to the second end of each support arm may have a pair of notches that correspond to the closed and open positions of the cover. The notches may be configured to receive a pin extending radially outwardly from the associated post to retain the cover in the closed and open positions. A screw may extend through a washer, through an interior region of a compression spring, through a slightly-oversized opening in the support arm and then threaded into a threaded opening in the associated post. The spring may be situated in a state of compression between the washer and the support arm.

In some embodiments, the notches in the rearwardly-facing annular surfaces of the collars attached to the first ends of the support arms and the associated radially-extending pins may be omitted. In some embodiments, the notches in the forwardly-facing annular surfaces of the collars attached to the second ends of the support arms and the associated radially-extending pins may be omitted. In some embodiments, the notches in the forwardly and rearwardly-facing annular surfaces of the collars attached to the first and second ends, respectively, of the support arms and the associated radially-extending pins may be omitted.

Additional features, which alone or in combination with any other feature(s), such as those listed above and those listed in the appended claims, may comprise patentable subject matter and will become apparent to those skilled in the art upon consideration of the following detailed description of illustrative embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION OF THE DRAWINGS

Figure 1:
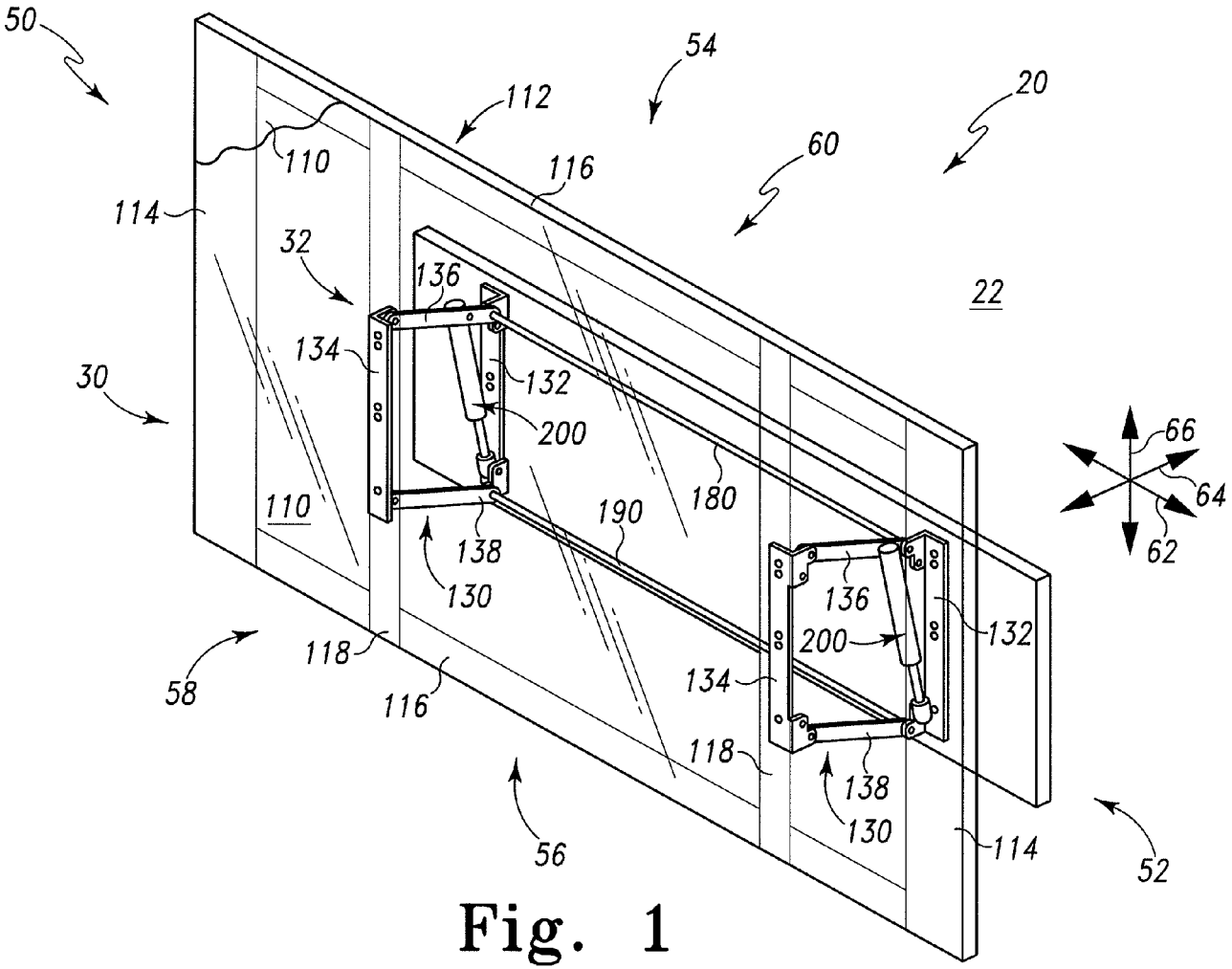
FIG. 1 is a perspective view of a headwall showing the headwall having a housing (shown in FIG. 2), a plurality of service outlets (shown in FIG. 2) coupled to the housing, a cover (such as a picture frame), and a pair of laterally-spaced parallelogram linkages coupled to the housing and coupled to the cover so that the cover is movable between a lowered position shown in FIG. 3 in which the cover blocks access to the plurality of service outlets and a raised position shown in FIG. 5 in which the cover allows access to the plurality of service outlets, and showing each parallelogram linkage including a frame bracket coupled to the housing, a cover bracket coupled to the cover, a pair of supporting arms each having a first end pivotably coupled to the frame bracket and a second end pivotably coupled to the cover bracket, and a gas spring extending between the upper support arm and a lower portion of the frame bracket.
Figure 2:
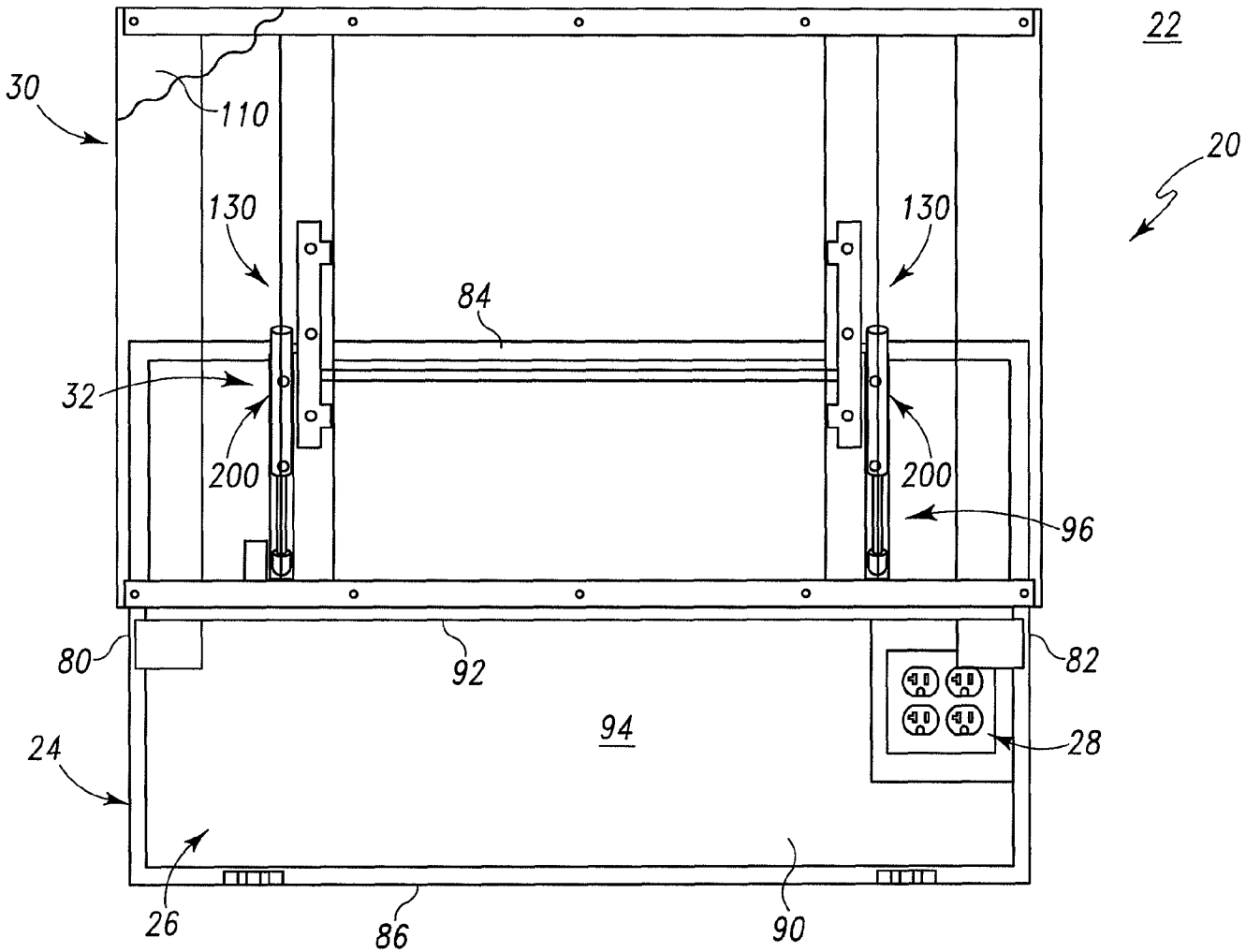
FIG. 2 is a front elevation of the headwall showing the cover in the raised position and a plurality of electrical outlets coupled to the housing.
Figure 3:
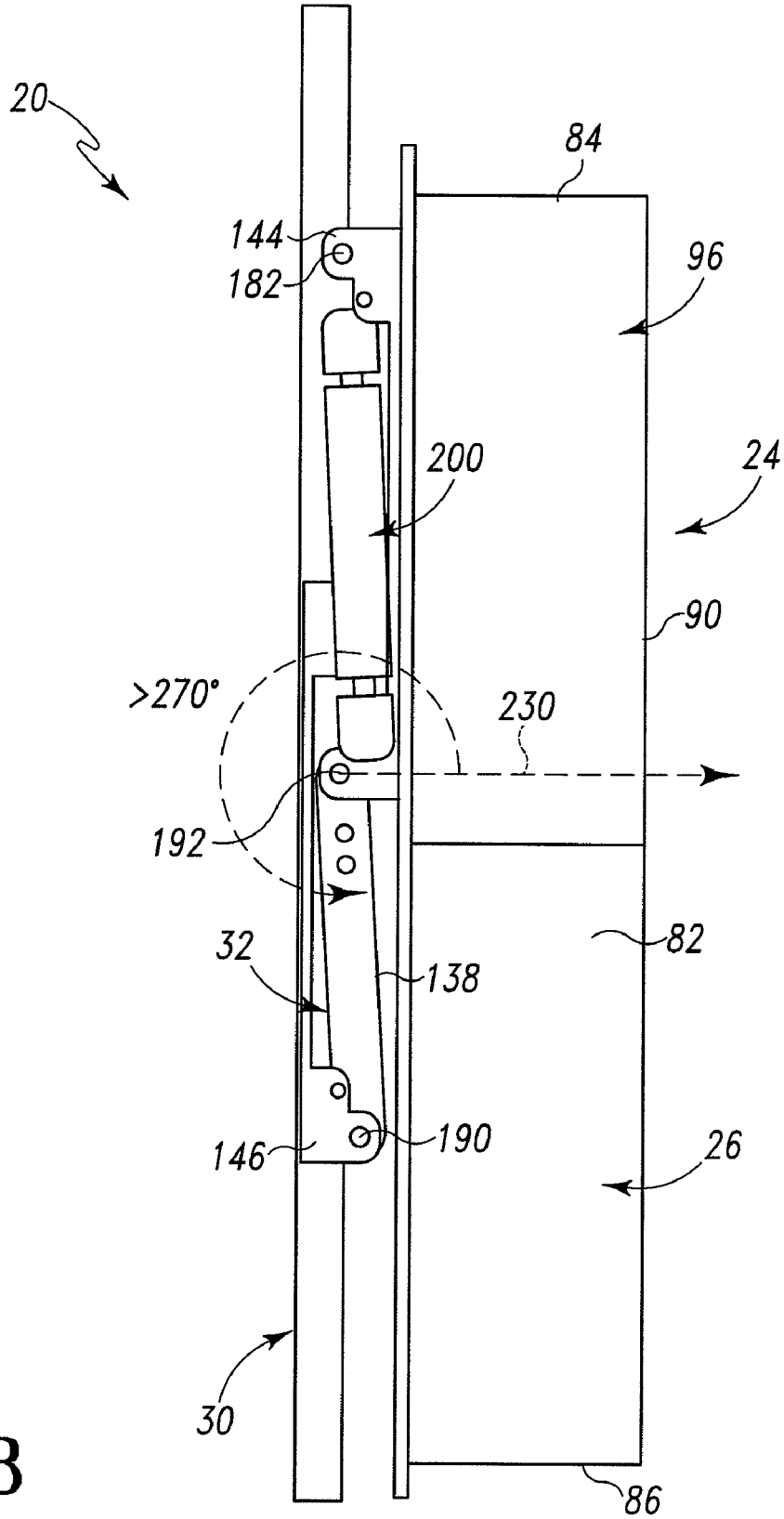
FIG. 3 is a side elevation view of the headwall showing the cover in the lowered position blocking access to the compartment.
Figure 4:
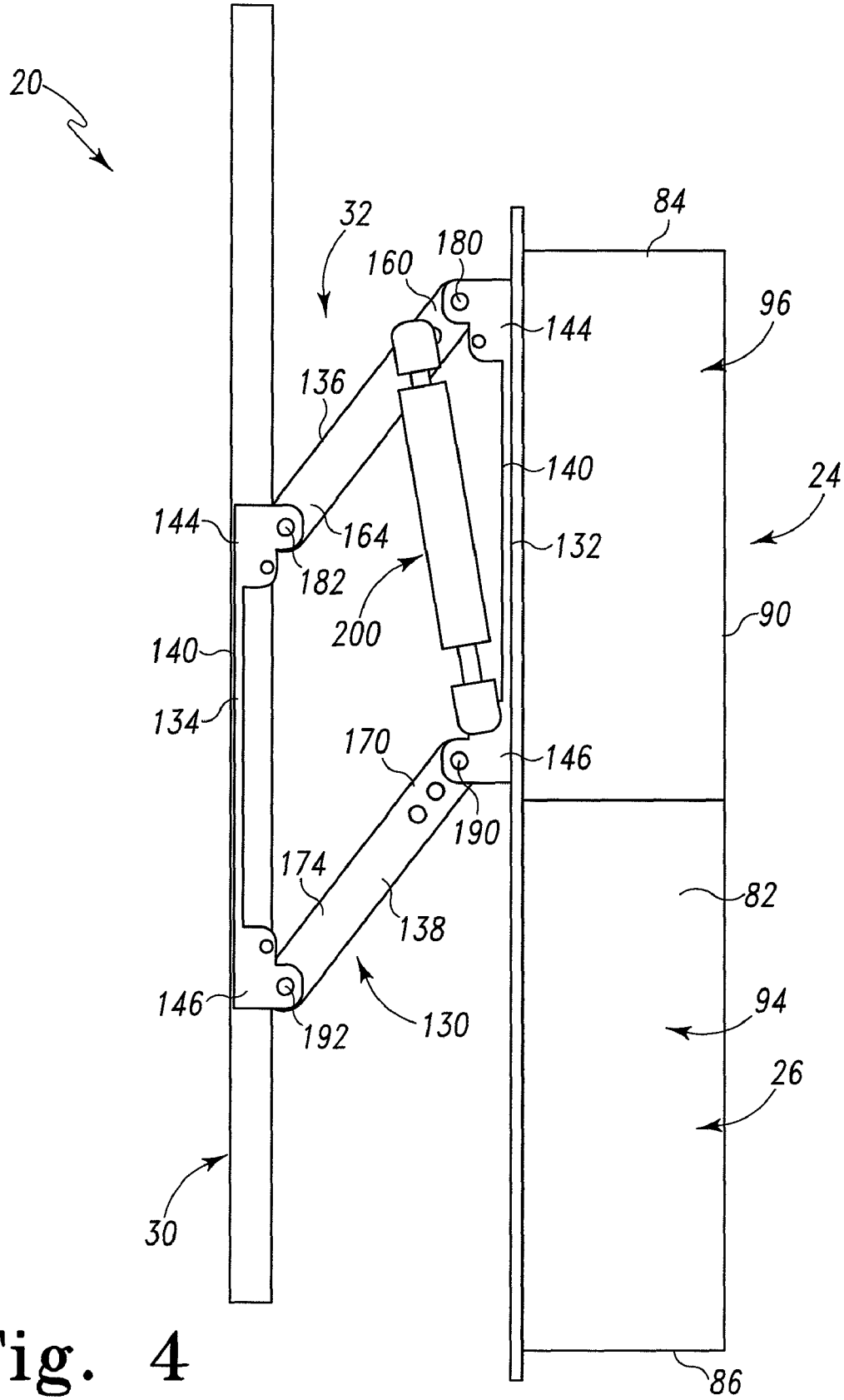
FIG. 4 is a side elevation view of the headwall showing the cover in an intermediate position.
Figure 5:
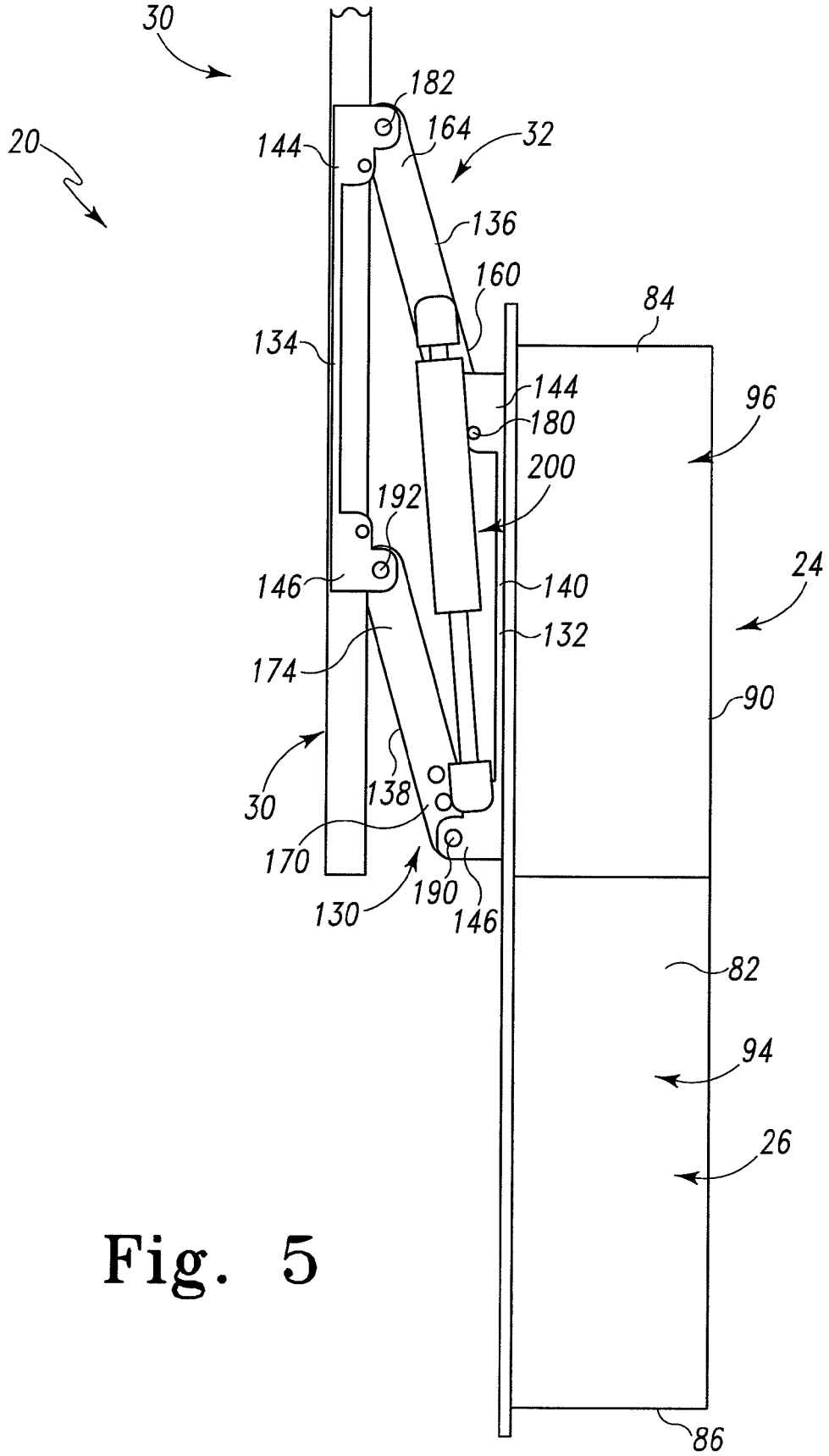
FIG. 5 is a side elevation view of the headwall showing the cover in the raised position allowing access to the compartment.
Figure 6:
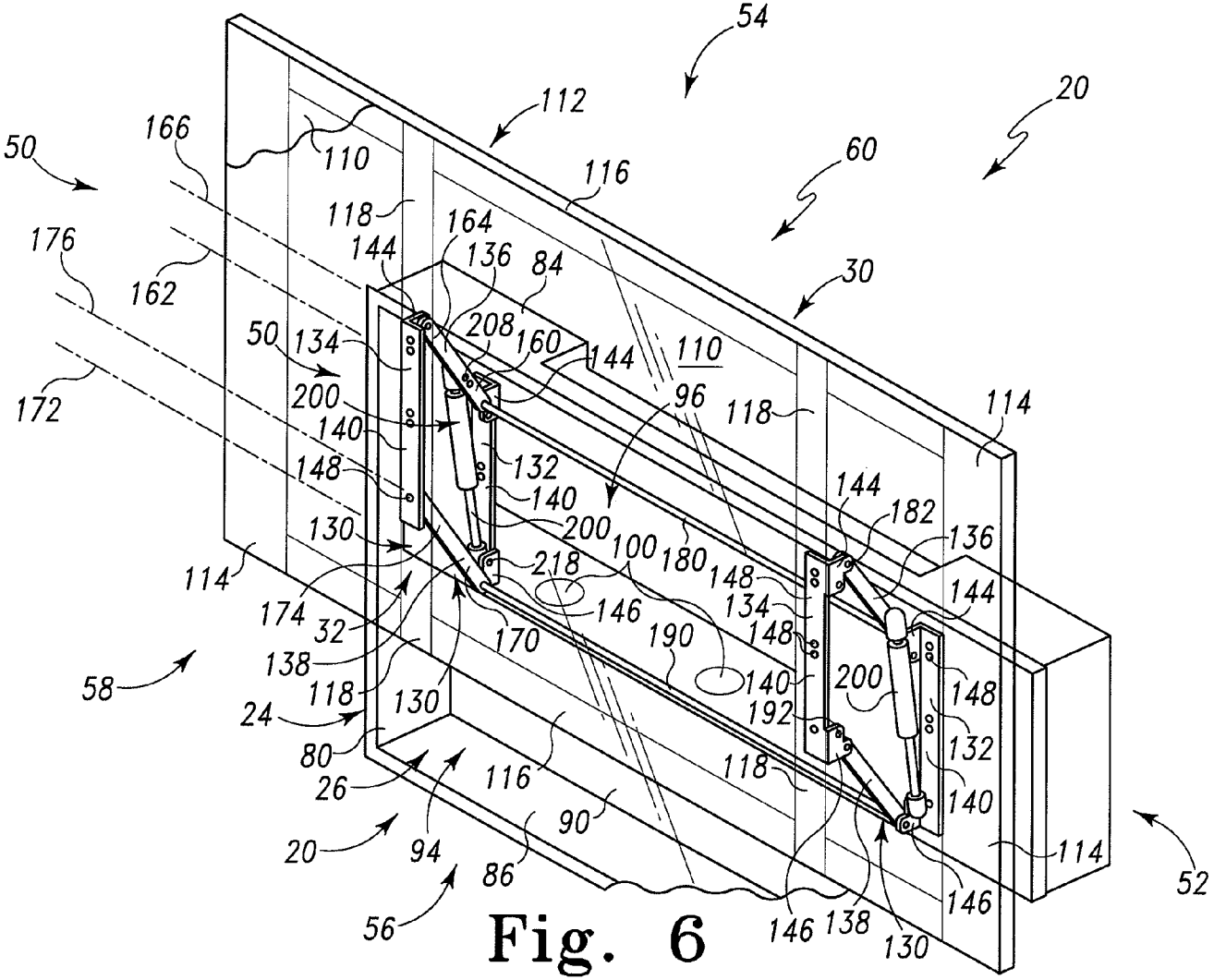
FIG. 6 is an enlarged perspective view, similar to FIG. 1, of the headwall.
Figure 10:
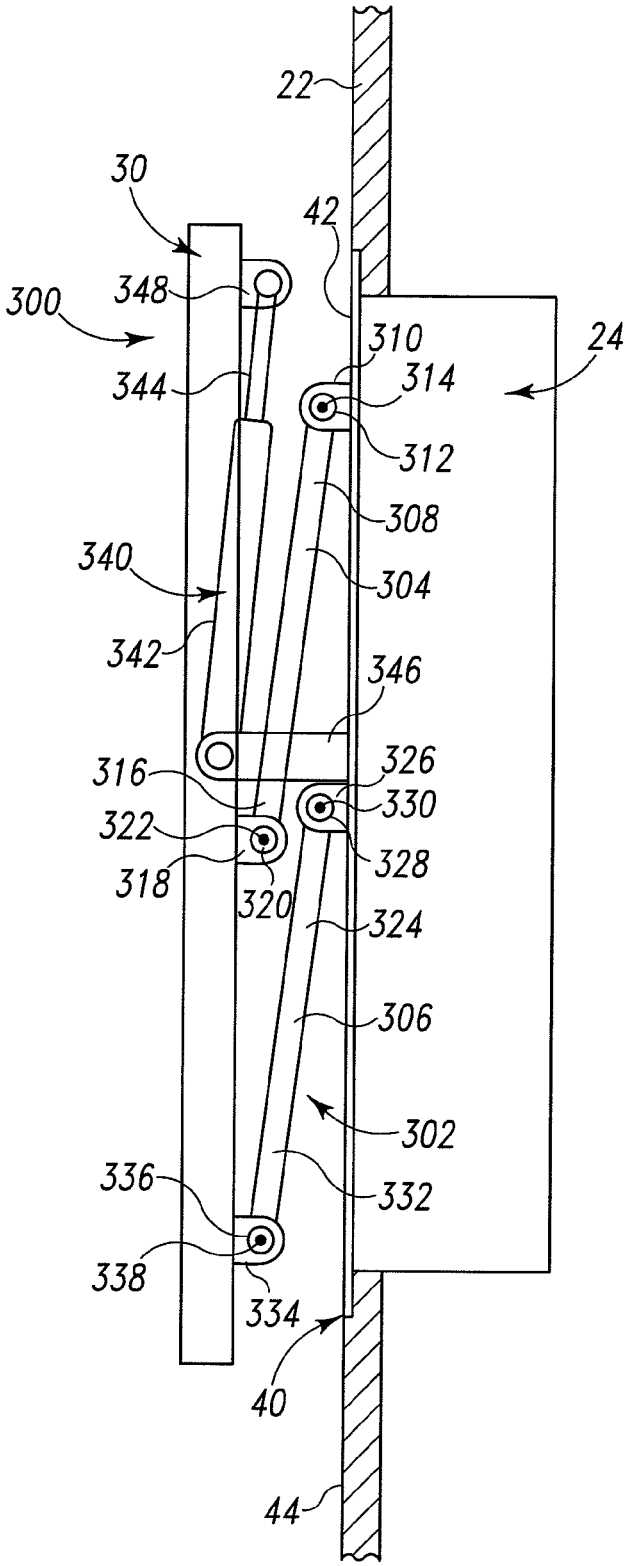
FIG. 10 is a perspective view showing a second embodiment of the headwall similar to the headwall shown in FIGS. 1-6.

Referring generally to FIGS. 1-6, and particularly to FIGS. 1-2 and 6, a headwall 20 includes an enclosure or housing 24 (FIG. 2) defining a compartment 26 (FIG. 2), a plurality of service outlets 28 (FIG. 2) coupled to the housing 24 and located in the compartment 26, a cover 30, and a linkage 32 for mounting the cover 30 to the housing for pivoting movement between a closed position shown in FIG. 3 in which the cover 30 blocks access to the service outlets 28 and a open position shown in FIG. 5 in which the cover 30 allows access to the service outlets 28. The housing 24 is configured to be received in a recess 40 (FIG. 10) formed in a wall 22 located in a patient care area of a healthcare facility, such as a hospital, a physician's office, a nursing home, and the like. When installed, a front surface 42 of the housing 24 is substantially parallel to and flush with a front surface 44 of the wall 22 as shown in FIG. 10. In some embodiments, however, the front surface 42 of the housing 24 may be offset from the front surface 44 of the wall 22.

In the illustrated embodiment, the cover 30 remains substantially vertical and parallel to the front surface 44 of the wall 22 as it travels between the closed and open positions. Also, in the illustrated embodiment, the open position of the cover 30 shown in FIG. 5 is higher than the closed position of the cover 30 shown in FIG. 3. In other embodiments, however, the closed position of the cover 30 is higher than the open position of the cover 30. The cover 30 may comprise a wall accessory, such as a picture frame, decoration, etc. Examples of service outlets 28 include, but are not limited to, the following: electrical outlets, emergency power outlets, low voltage outlets, medical gas outlets (such as oxygen, nitrogen, etc.), air outlets, vacuum outlets, data ports, communication ports, and the like.

As shown in FIG. 1, the headwall 20 has a left side 50, a right side 52, a top side 54, a bottom side 56, a front side 58, a back side 60, a lateral axis 62 extending along a width dimension thereof, a longitudinal axis 64 extending along a depth dimension thereof, and a vertical axis 66 extending along a height dimension thereof. As used in this description, the phrases "left side 50," "right side 52," "top side 54," "bottom side 56," "front side 58," "back side 60," will be used to denote the end of any referred-to object that is positioned to lie nearest the left side 50, right side 52, top side 54, bottom side 56, front side 58, back side 60 of the headwall 20, respectively.

As shown in FIG. 2, the box-shaped housing 24 has a left wall 80, a right wall 82, a top wall 84, a bottom wall 86, and a back wall 90. A front side 58 of the housing 24 is open to the atmosphere. A shelf 92 (FIG. 6) divides an interior space 94 of the housing 24 into an upper compartment 96 and a lower compartment 26. The lower compartment 26 houses the services outlets 28. In the illustrated embodiment, the service lines (not shown) are first brought into the upper compartment 96 and then routed to the lower compartment 26 through openings 100 (FIG. 6) in the shelf 92 for connection to the respective service outlets 28. The housing 24 includes horizontally and vertically-extending frame members (not shown) that support the service outlets 28 in the lower compartment 26 and that support the valves, conduits etc. (not shown) in the upper compartment 96. The dimensions of the housing 24 will vary with the number of service outlets 28 required in a given patient care area and the kind of patient care equipment that will be connected to the service outlets 28. Examples of patient care equipment include, but are not limited to, the following: heart monitoring equipment, medical gas delivery equipment, infusion management equipment, equipment monitors, patient monitors, defibrillators, suction equipment, and the like, many of which directly connect to the patient via lines or tubes.

As shown in FIGS. 1 and 6, the rectangular cover 30 includes a panel 110 secured to a mounting frame 112. For illustrative purposes only, a transparent panel 110 is shown. However, the panel 110 typically comprises a wall accessory, such as a picture frame, decoration, etc. The frame 112 includes a pair of vertically-extending frame members 114 which are held a laterally-spaced relationship by a pair of laterally-extending frame members 116. In addition, two laterally-spaced vertically-extending frame members 118 are provided, to which the linkage 32 is attached. The dimensions of the cover 32 will depend on the size of the housing 24. The cover 30 defines a footprint when projected toward the wall 22. The housing 24 lies inside the footprint of the cover 30 when the cover 30 is in the closed position as shown in FIG. 3.

Figure 7:
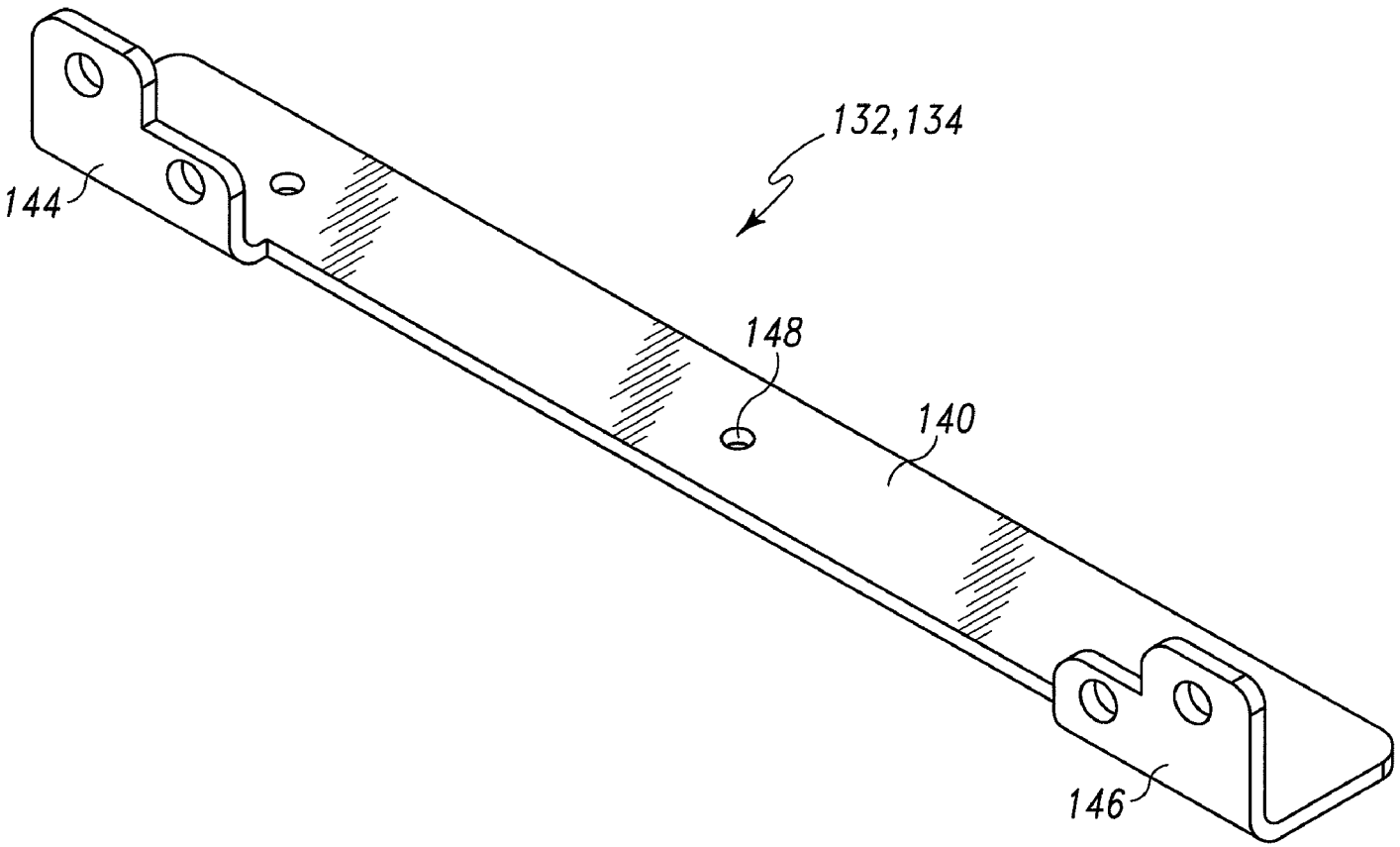
FIG. 7 is a perspective view of one of the brackets of the parallelogram linkages.

As shown in FIG. 6, in the illustrated embodiment, the linkage 32 comprises a pair of laterally-spaced parallelogram linkages 130 located on the left and right sides 50, 52, respectively. The left and right parallelogram linkages 130 are identical. Each parallelogram linkage 130 includes a frame bracket 132 coupled to the housing 24, a cover bracket 134 coupled to the cover 30, and upper and lower support arms 136, 138, respectively. As shown in FIG. 7, each bracket 132, 134 has a base portion 140 and upper and lower flanges 144, 146 that extend perpendicularly outwardly from the base portion 140. As shown, for example, in FIGS. 4-5, the base portion 140 of the frame bracket 132 is secured to a frame member (not shown) of the housing 24 above the lower compartment 26 by suitable fasteners, such as screws, which extend through openings 148 in the base portion 140. Likewise, as shown, for example, in FIGS. 1, 6, the base portion 140 of the cover bracket 134 is secured to the frame member 118 of the cover 30 by suitable fasteners, such as screws, which extend through the openings 148 in the base portion 140.

As shown in FIG. 6, the upper support arms 136 have rear ends 160 coupled to the forwardly-extending upper flanges 144 of the frame brackets 132 for pivoting movement about an upper-rear connecting rod 180 defining a laterally-extending upper-rear pivot axis 162. The upper support arms 136 have front ends 164 coupled to the rearwardly-extending upper flanges 144 of the cover brackets 134 for pivoting movement about laterally-extending pivot pins 182 defining a laterally-extending upper-front pivot axis 166. Likewise, the lower support arms 138 have rear ends 170 coupled to the forwardly-extending lower flanges 146 of the frame brackets 132 for pivoting movement about a lower-rear connecting rod 190 defining a laterally-extending lower-rear pivot axis 172. The lower support arms 138 have front ends 174 coupled to the rearwardly-extending lower flanges 146 of the cover brackets 134 for pivoting movement about laterally-extending pivot pins 192 defining a laterally-extending lower-front pivot axis 176. Thus, in the illustrated embodiment, the two parallelogram linkages 130 define four (4) laterally-extending pivot axes: the upper-rear pivot axis 162, the upper-front pivot axis 166, the lower-rear pivot axis 172, and the lower-front pivot axis 176.

Figure 8:
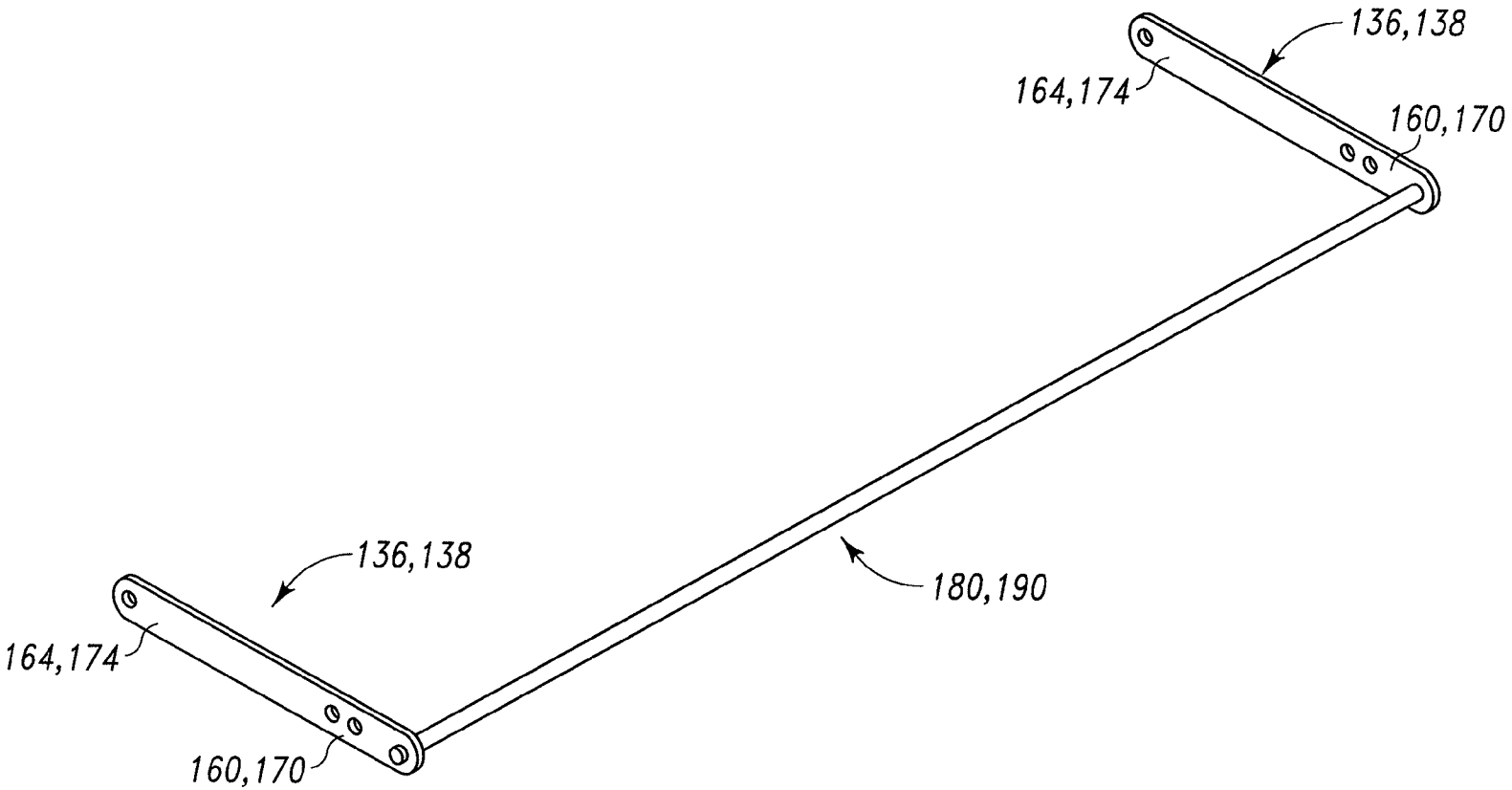
FIG. 8 is a perspective view showing a connecting rod extending between the rear ends of the support arms of the parallelogram linkages.

As shown in FIG. 8, the upper connecting rod 180 rigidly connects the rear ends 160 of the two upper support arms 136. Likewise, the lower connecting rod 190 rigidly connects the rear ends 170 of the two lower support arms 138. The upper and lower connecting rods 180, 190 ensure that the two linkages 130 on the left and right sides 50, 52 of the headwall 20 move in unison as the cover 30 travels between lowered and raised positions shown respectively in FIGS. 3 and 5. In addition, the upper and lower connecting rods 180, 190 ensure that the cover 30 remains parallel to the wall 22 as it travels between lowered and raised positions.

Figure 9:
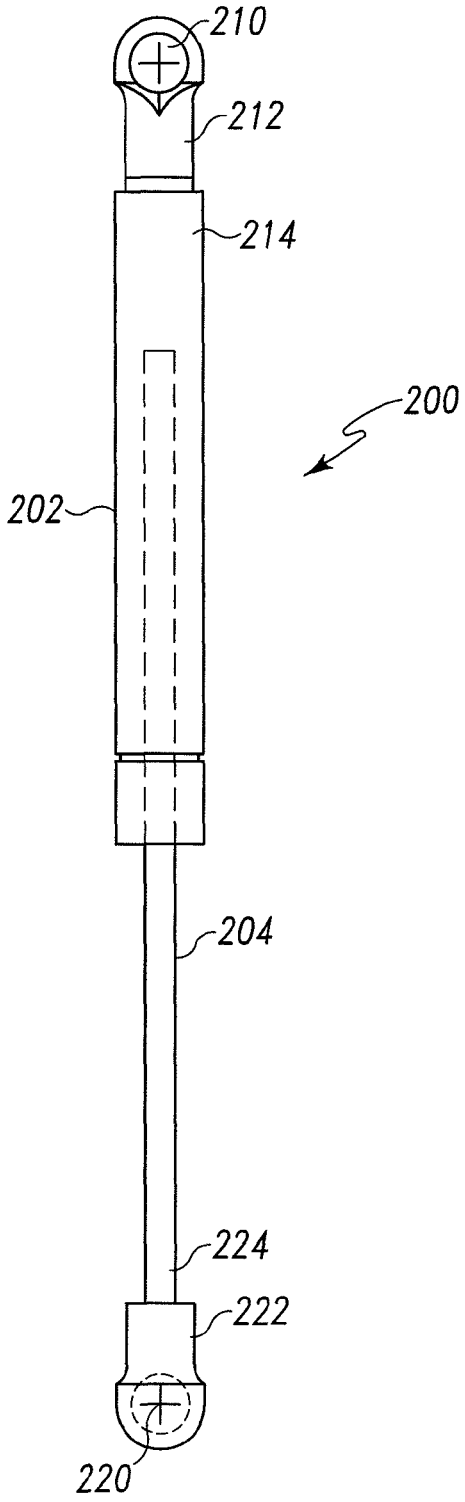
FIG. 9 is a perspective view of one of the gas springs providing assisted lift and controlled descent of the cover.

Each parallelogram linkage 130 further includes a gas spring 200 that comprises a cylinder 202 and a piston rod 204 that extends out of and retracts into the cylinder 202. In the illustrated embodiment, each cylinder 202 is coupled to the associated upper support arm 136 for pivoting movement about a pivot pin (not shown) that extends through an opening 208 (FIG. 6) in the associated upper support arm 136 and an opening 210 (FIG. 9) in a flange 212 that extends upwardly from an upper end 214 of the cylinder 202. Each piston rod 204 is coupled to the lower flange 146 of the associated frame bracket 132 for pivoting movement about a pivot pin (not shown) that extends through an opening 218 (FIG. 6) in the lower flange 146 of the associated frame bracket 132 and an opening 220 (FIG. 9) in a flange 222 that extends downwardly from a lower end 224 of the piston rod 204. In some embodiments, however, each piston rod 204 is coupled to the associated upper support arm 136 and each cylinder 202 is coupled to the lower flange 146 of the associated frame bracket 132.

The gas springs 200 provide assisted lift and controlled descent of the cover 30. The cover 30 passes through an overcenter position, which is about 270 degrees relative to a rearwardly-extending axis 230 (FIG. 3), during its movement from the raised position shown in FIG. 5 to the lowered position shown in FIG. 3. In the lowered position shown in FIG. 3, the cover 30 makes about 271 degree or greater angle relative to the rearwardly-extending axis 230. In this past-the- 270-degree overcenter position of the cover 30, gas spring assist is not effective to lift the cover 30 to its raised position shown in FIG. 5. However, gas spring assist becomes effective when the caregiver moves the cover 30 to a position where the angle subtended by the cover 30 relative to the rearwardly-extending axis 230 is 269 degrees or less. In some other embodiments, the linkage assemblies 130 include detents for retaining the cover 30 in the lowered and raised positions shown respectively in FIGS. 3 and 5. While the gas springs 200 are used in the illustrated embodiment, other counterbalance mechanisms may very well be used in lieu of the gas springs 200. In the illustrated embodiment, the gas springs 200 are of the type marketed by JWF Technologies as Stabilus® Lift-O-Mat® gas springs. Each gas spring 200 has a rating of about 150N force.

FIG. 10 shows a second embodiment 300 of the headwall 20 shown in FIGS. 1-6. The headwall 300 is generally similar to the headwall 20 of FIGS. 1-6 except that parallelogram linkages 302 are used in lieu of the parallelogram linkages 130. Like reference numbers will be used to denote similar parts. Each parallelogram linkage 302 includes upper and lower support arms 304, 306. The upper support arms 304 have rear ends 308 coupled to upper flanges 310 (which extend forwardly from the housing 24) for pivoting movement about an upper connecting rod 312 defining a laterally-extending upper-rear pivot axis 314. The upper support arms 304 have front ends 316 coupled to upper flanges 318 (which extend rearwardly from the cover 30) for pivoting movement about respective laterally-extending pins 320 defining a laterally-extending upper-front pivot axis 322. Likewise, the lower support arms 306 have rear ends 324 coupled to lower flanges 326 (which extend forwardly from the housing 24) for pivoting movement about a lower connecting rod 328 defining a laterally-extending lower-rear pivot axis 330. The lower support arms 306 have front ends 332 coupled to lower flanges 334 (which extend rearwardly from the cover 30) for pivoting movement about respective laterally-extending pins 336 defining a laterally-extending lower-front pivot axis 338. Thus, the two parallelogram linkages 302 define four (4) laterally-extending pivot axes: the upper-rear pivot axis 314, the upper-front pivot axis 322, the lower-rear pivot axis 330, and the lower-front pivot axis 338.

The upper and lower connecting rods 312, 328 rigidly connect the rear ends 308, 324 of the upper and lower support arms 304, 306, respectively. The upper and lower connecting rods 312, 328 ensure that the two linkages 302 on the left and right sides 50, 52 of the headwall 300 move in unison as the cover 30 travels between lowered and raised positions. In addition, the upper and lower connecting rods 312, 328 ensure that the cover 30 remains parallel to the wall 22 as it travels between lowered and raised positions. Each parallelogram linkage 302 further includes a gas spring 340 that comprises a cylinder 342 and a piston rod 344 that extends out of and retracts into the cylinder 342. In the illustrated embodiment, each cylinder 342 is coupled to a flange 346 that extends forwardly from the housing 24. Each piston rod 344 is coupled to a flange 348 that extends rearwardly from the cover 30. The gas springs 340, like the gas springs 200, provide assisted lift and controlled descent of the cover 30. In the illustrated embodiment, the gas springs 340 are of the type marketed by JWF Technologies as Stabilus® Lift-O-Mat® gas springs.

Figures 11, 12:
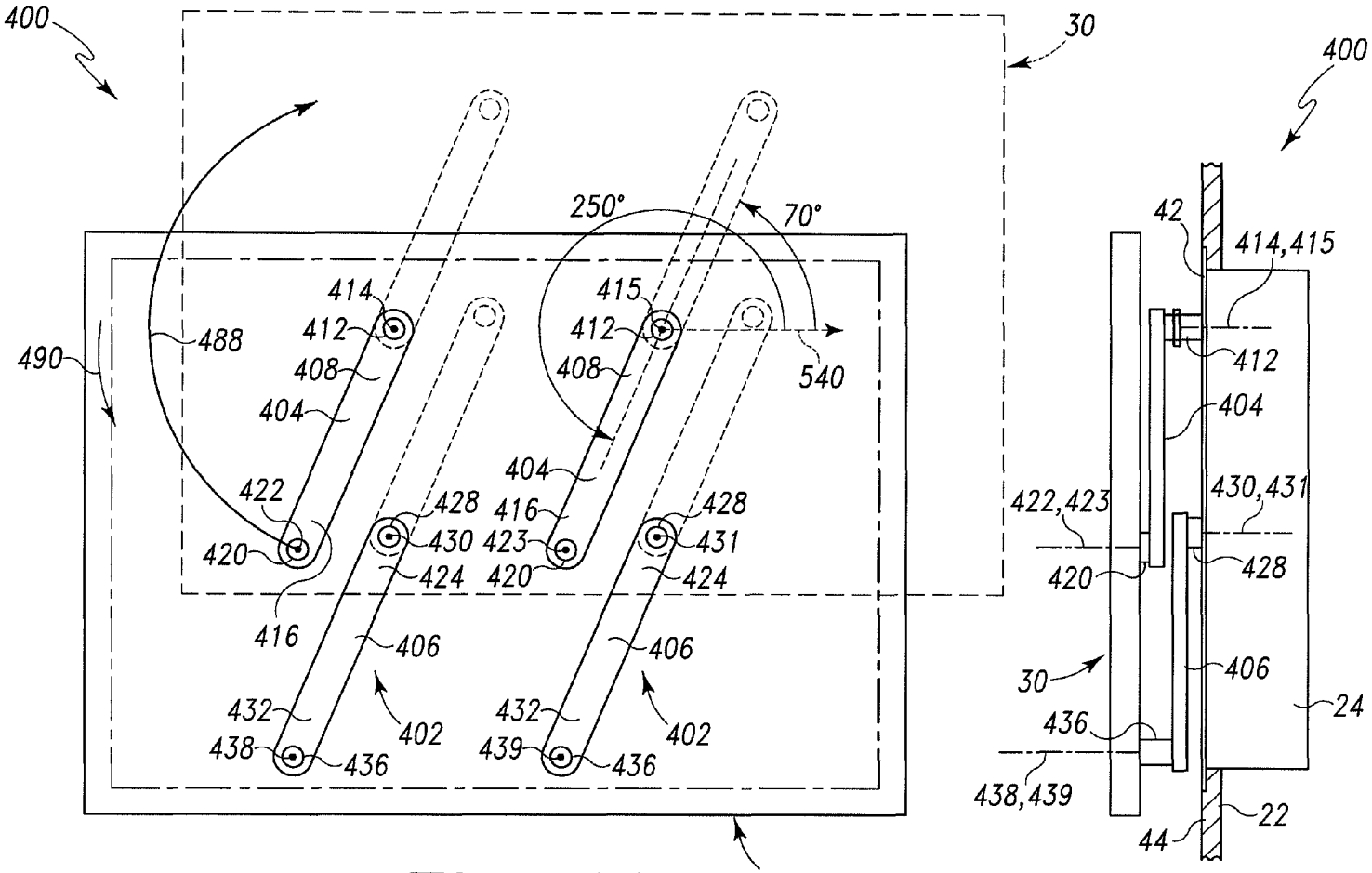
FIG. 11 is a front elevation view of a third embodiment of the headwall similar to the headwall shown in FIGS. 1-6, except that the laterally-spaced parallelogram linkages of FIG. 11 pivot about longitudinally-extending pivot axes, instead of laterally-extending pivot axes.
FIG. 12 is a side elevation view of the headwall of FIG. 11.

FIGS. 11-14 show a third embodiment 400 of the headwall 20 shown in FIGS. 1-6. The headwall 400 is generally similar to the headwall 20 of FIGS. 1-6 except that parallelogram linkages 402 defining eight (8) longitudinally-extending pivot axes 414, 415, 422, 423, 430, 431, 438, 439 are used in lieu of the parallelogram linkages 130 defining four (4) laterally-extending pivot axes 162, 166, 172, 176. In addition, the headwall 400 uses detents mechanisms (FIGS. 13-14), instead of the gas springs 200. Like reference numbers will be used to denote similar parts. As shown in FIGS. 11-12, each parallelogram linkage 402 includes upper and lower support arms 404, 406. The upper support arms 404 have upper ends 408 coupled to the housing 24 for pivoting movement about respective upper pivot posts 412 which extend forwardly and longitudinally from the housing 24. The pivot posts 412 define respective longitudinally-extending upper-rear pivot axes 414, 415. The upper support arms 404 have lower ends 416 coupled to the cover 30 for pivoting movement about respective upper pivot posts 420 which extend rearwardly and longitudinally from the cover 30. The pivot posts 420 define respective longitudinally-extending upper-front pivot axes 422, 423. Likewise, the lower support arms 406 have upper ends 424 coupled to the housing 24 for pivoting movement about respective lower pivot posts 428 which extend forwardly and longitudinally from the housing 24. The pivot posts 428 define respective longitudinally-extending lower-rear pivot axes 430, 431. The lower support arms 406 have lower ends 432 coupled to the cover 30 for pivoting movement about respective lower pivot posts 436 which extend rearwardly and longitudinally from the cover 30. The pivot posts 436 define respective longitudinally-extending lower-front pivot axes 438, 439.

Figure 13:
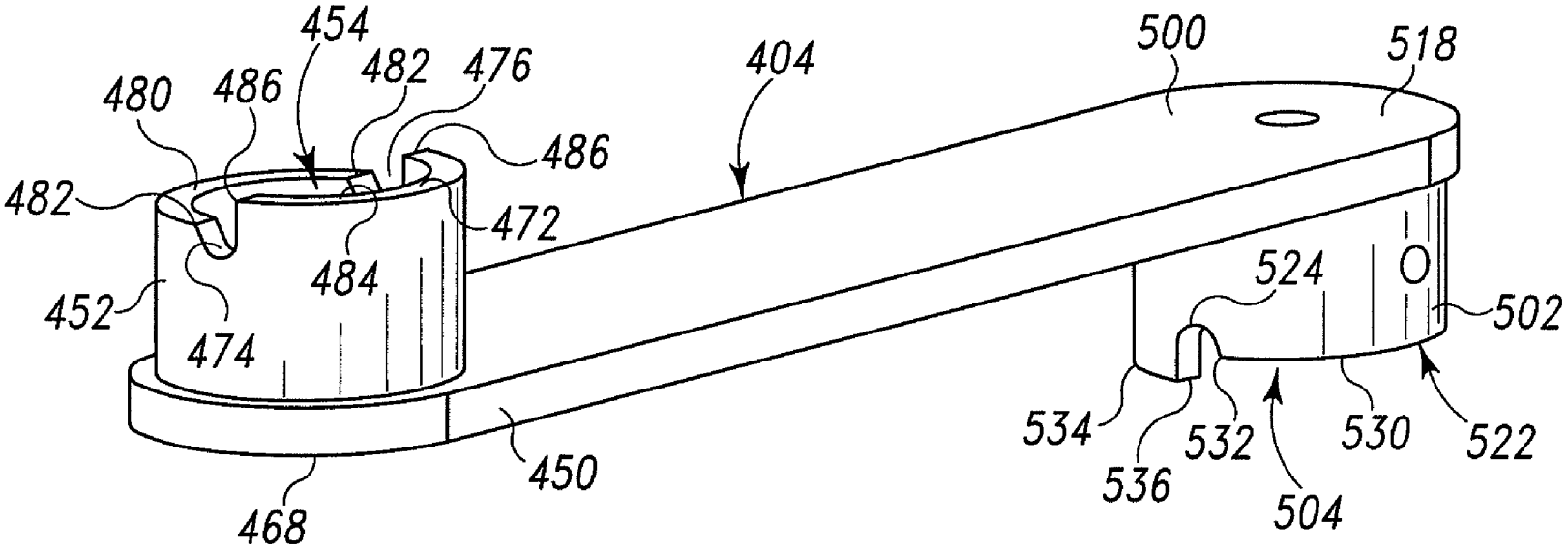
FIG. 13 is a perspective view of one of the supporting arms of the parallelogram linkages of FIG. 11.
Figure 14:
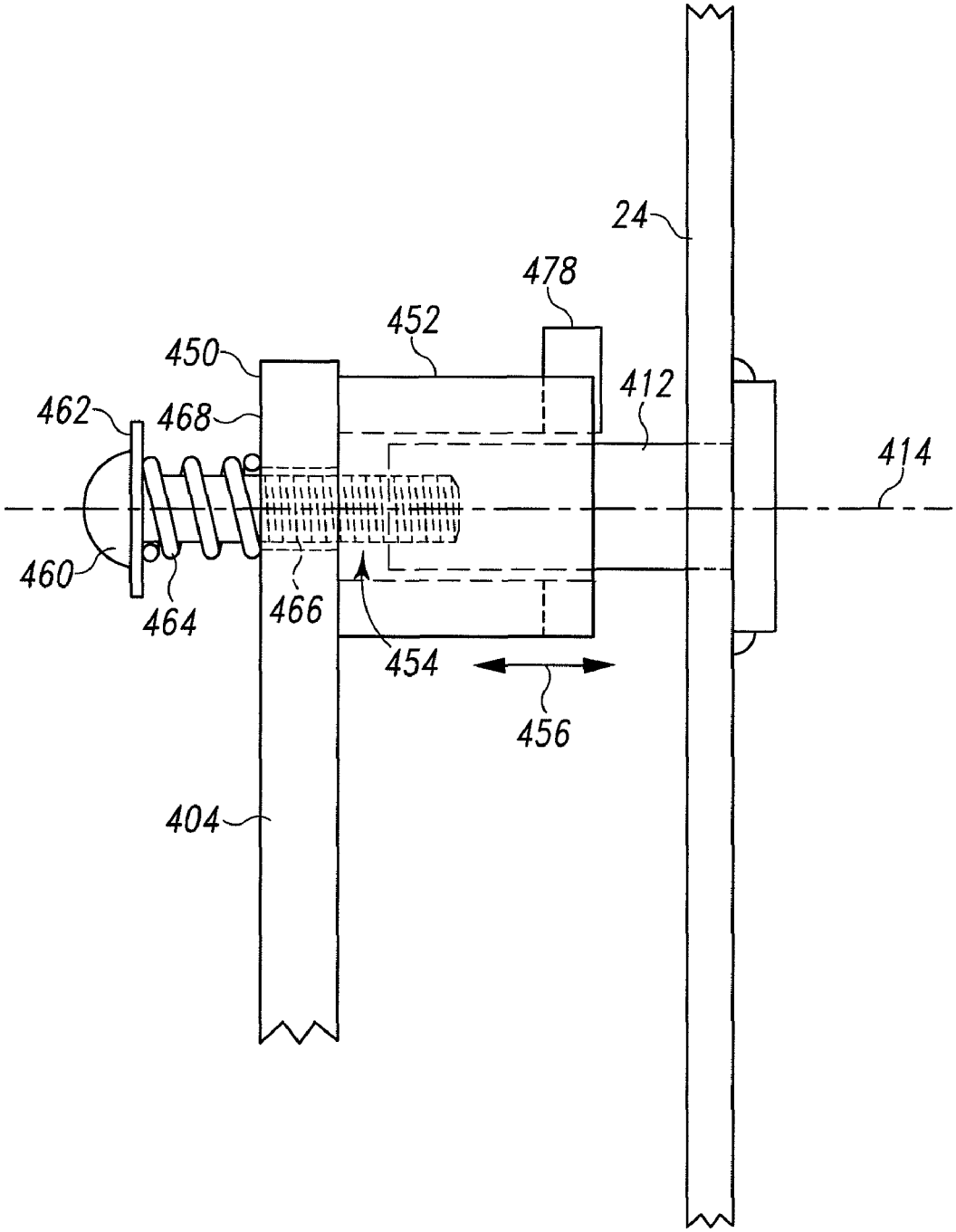
FIG. 14 is a cross sectional view of a detent mechanism for retaining the cover in the lowered and raised positions.

The four support arms 404, 406 are identical in construction. Only the upper support arm 404 of the parallelogram linkage 402 on the left side 50 of the headwall 400 will be described below. The construction and operation of the remaining three support arms 404, 406 is similar. As shown in FIGS. 13-14, in the illustrated embodiment, the upper end 450 of the upper-left support arm 404 has a collar 452 that extends rearwardly toward the housing 24. The collar 452 has a bore 454 for receiving the associated pivot post 412 that extends forwardly from the housing 24 so that the upper-left support arm 404 is rotatable about the longitudinally-extending pivot axis 414 defined by the pivot post 412. The inside diameter of the bore 454 is slightly larger than the outside diameter of the pivot post 412 so that the collar 454 is longitudinally slidable relative to the pivot post 412 as shown by a double-headed arrow 456 in FIG. 14.

As shown in FIG. 14, in the illustrated embodiment, a screw 460 extends through a washer 462, through an interior region of a compression spring 464, through a slightly-oversized opening 466 in the upper-left support arm 404 and then threaded into a threaded opening in the pivot post 412. The spring 464 is held in a state of compression between the washer 462 and the forwardly-facing surface 468 of the upper-left support arm 404 to bias the support arm 404 toward the pivot post 412. As shown in FIG. 13, a rearwardly-facing annular surface 472 of the collar 452 has a pair of notches 474, 476 that correspond to the closed position (shown in solid in FIG. 11) and the open position (shown in phantom in FIG. 11). The notches 474, 476 are configured to receive a pin 478 (FIG. 14) that extends radially outwardly from the pivot post 412 to releasably retain the cover 30 in the closed and open positions. A left-half portion 480 of the rearwardly-facing annular surface 472 of the collar 452 extending between left edges 482 of the notches 474, 476 is axially indented relative to a right-half portion 484 of the rearwardly-facing annular surface 472 extending between right edges 486 of the notches 474, 476 to ensure that that the cover 30 can only rotate in a clockwise direction 488 (FIG. 11) as it travels from the lowered position to the raised position. The indented surfaces 480 also ensure that that the cover 30 can only rotate in a counterclockwise direction 490 (FIG. 11) as it travels from the raised position to the lowered position.

Likewise, the lower end 500 of the upper-left support arm 404 has a collar 502 that extends forwardly toward the cover 30. The collar 502 has a bore 504 for receiving the associated pivot post 420 (FIG. 12) that extends rearwardly from the cover 30 so that the upper-left support arm 404 is rotatable about the longitudinally-extending pivot axis 422 defined by the pivot post 420. The inside diameter of the bore 504 is slightly larger than the outside diameter of the pivot post 420 so that the collar 504 is longitudinally slidable relative to the pivot post 420.

As shown in FIG. 14 with respect to the upper end 450 of the upper-left support arm 404, a screw 460 extends through a washer 462, through an interior region of a compression spring 464, through a slightly-oversized opening 466 in the upper-left support arm 404 and then threaded into a threaded opening in the pivot post 420 extending rearwardly from the cover 30. The spring 464 is held in a state of compression between the washer 462 and the rearwardly-facing surface 518 (FIG. 13) of the upper-left support arm 404 to bias the support arm 404 toward the pivot post 420. A forwardly-facing annular surface 522 of the collar 502 has a pair of notches 524, 526 that correspond to the closed position of the cover 30 (shown in solid in FIG. 11) and the open position of the cover 30 (shown in phantom in FIG. 11). The notches 524, 526 are configured to receive a pin (not shown) that extends radially outwardly from the pivot post 420 to releasably retain the cover 30 in the closed and open positions.

As shown in FIG. 13 with respect to the rearwardly-facing annular surface 472 of the collar 452, a right-half portion 530 of the forwardly-facing annular surface 522 of the collar 502 extending between right edges 532 of the notches 524, 526 is axially indented relative to a left-half portion 534 of the forwardly-facing annular surface 522 extending between left edges 536 of the notches 524, 526 to ensure that that the cover 30 can only rotate in a clockwise direction 488 (FIG. 11) as it travels from the lowered position to the raised position. The indented surfaces 530 also ensure that that the cover 30 can only rotate in a counterclockwise direction 490 (FIG. 11) as it travels from the raised position to the lowered position. The cover 30 must be pulled outwardly to release the detent mechanisms so that it can be raised or lowered.

In some embodiments, the notches 474, 476 in the rearwardly-facing annular surfaces 472 of the collars 452 attached to the upper ends 450 of the support arms 404, 406 and the associated radially-extending pins (not shown) are omitted. In some embodiments, the notches 524, 526 in the forwardly-facing annular surfaces 522 of the collars 502 attached to the lower ends 500 of the support arms 404, 406 and the associated radially-extending pins (not shown) are omitted.

As the cover 30 moves from the lowered position shown in solid in FIG. 11 to the raised position shown in phantom in FIG. 11, it shifts rightwardly. In the lowered position, the support arms 404, 406 make about 250 degree angle relative to a leftwardly-extending reference axis 540. During its travel from the lowered position to the raised position, the cover 30 passes through an overcenter position where the support arms 404, 406 extend vertically upwardly from the respective pivot posts 412, 420, 428, 436. In the overcenter position, the support arms 404, 406 make about 90 degree angle relative to the reference axis 540. In the raised position, the support arms 404, 406 make about 70 degree angle relative to the reference axis 540. In this past-the-overcenter position of the cover 30, the weight of the cover 30 assists in holding the cover 30 in the raised position.

Figure 15:
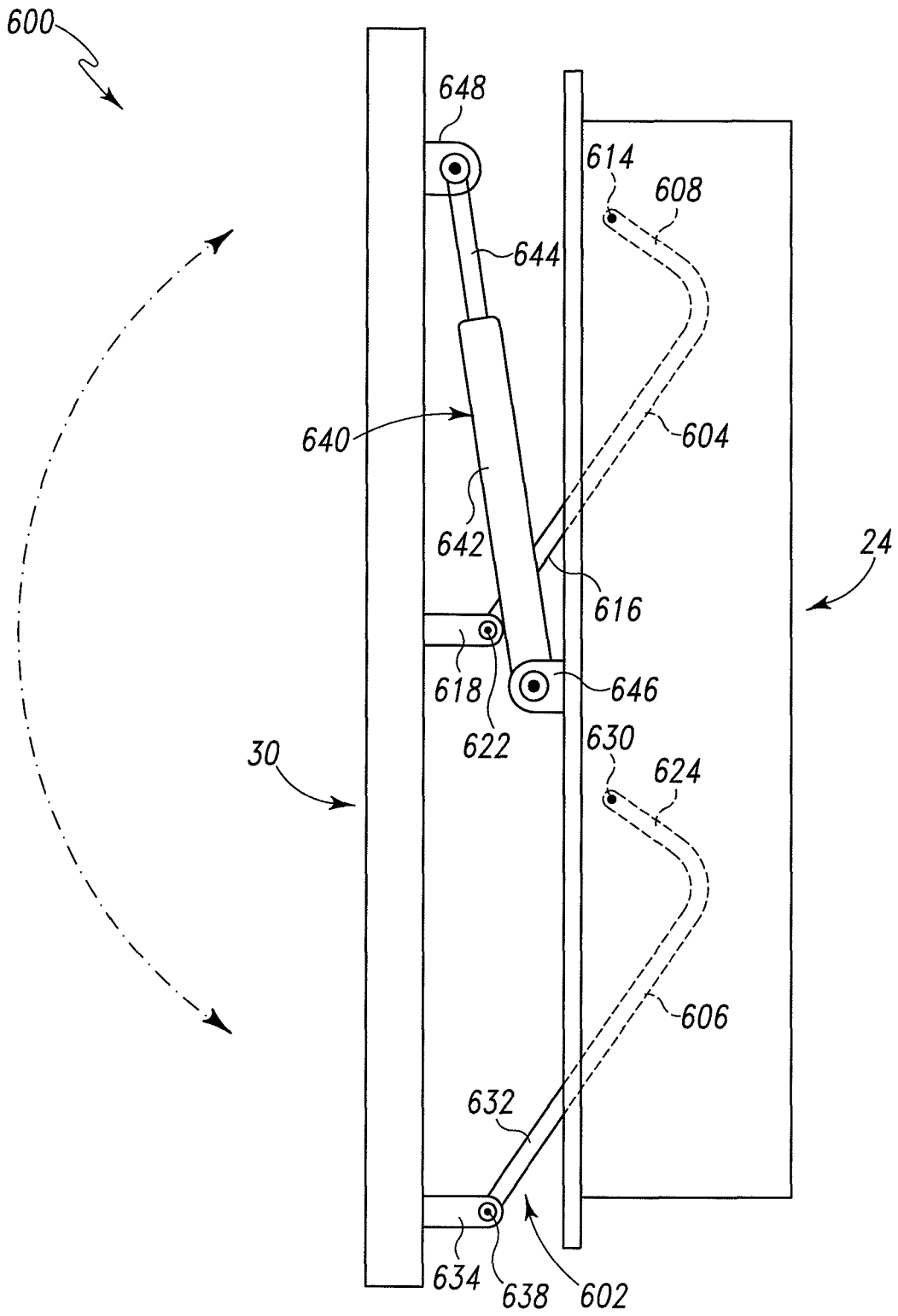
FIG. 15 is a side elevation view of a fourth embodiment of the headwall similar to the headwall shown in FIGS. 1-6, except that the laterally-spaced parallelogram linkages of FIG. 15 use bent support arms, instead of straight support arms.

FIG. 15 shows a fourth embodiment 600 of the headwall 20 shown in FIGS. 1-6. The headwall 600 is generally similar to the headwall 20 of FIGS. 1-6 except that bent support arms 604, 606 are used in lieu of the straight support arms 136, 138. Like reference numbers will be used to denote similar parts. Each parallelogram linkage 602 includes upper and lower bent support arms 604, 606. The upper bent support arms 604 have rear ends 608 coupled to upper flanges (which are not shown, but extend forwardly from the housing 24) for pivoting movement about an upper connecting rod (not shown) defining a laterally-extending upper-rear pivot axis 614. The upper bent support arms 604 have front ends 616 coupled to upper flanges 618 (which extend rearwardly from the cover 30) for pivoting movement about respective laterally-extending pins (not shown) defining a laterally-extending upper-front pivot axis 622. Likewise, the lower support arms 606 have rear ends 624 coupled to lower flanges (which are not shown, but extend forwardly from the housing 24) for pivoting movement about a lower connecting rod (not shown) defining a laterally-extending lower-rear pivot axis 630. The lower support arms 606 have front ends 632 coupled to lower flanges 634 (which extend rearwardly from the cover 30) for pivoting movement about respective laterally-extending pins (not shown) defining a laterally-extending lower-front pivot axis 638. Thus, the two parallelogram linkages 602 define four (4) laterally-extending pivot axes: the upper-rear pivot axis 614, the upper-front pivot axis 622, the lower-rear pivot axis 630, and the lower-front pivot axis 638.

The upper and lower connecting rods (not shown) rigidly connect the rear ends 608, 624 of the upper and lower support arms 604, 606, respectively. The upper and lower connecting rods (not shown) ensure that the two linkages 602 on the left and right sides 50, 52 of the headwall 600 move in unison as the cover 30 travels between lowered and raised positions. In addition, the upper and lower connecting rods (not shown) ensure that the cover 30 remains parallel to the wall 22 as it travels between lowered and raised positions. Each parallelogram linkage 602 further includes a gas spring 640 that comprises a cylinder 642 and a piston rod 644 that extends out of and retracts into the cylinder 642. In the illustrated embodiment, each cylinder 642 is coupled to a flange 646 that extends forwardly from the housing 24. Each piston rod 644 is coupled to a flange 648 that extends rearwardly from the cover 30. The gas springs 640, like the gas springs 200, provide assisted lift and controlled descent of the cover 30. In the illustrated embodiment, the gas springs 640 are of the type marketed by JWF Technologies as Stabilus® Lift-O-Mat® gas springs.

Figure 16:
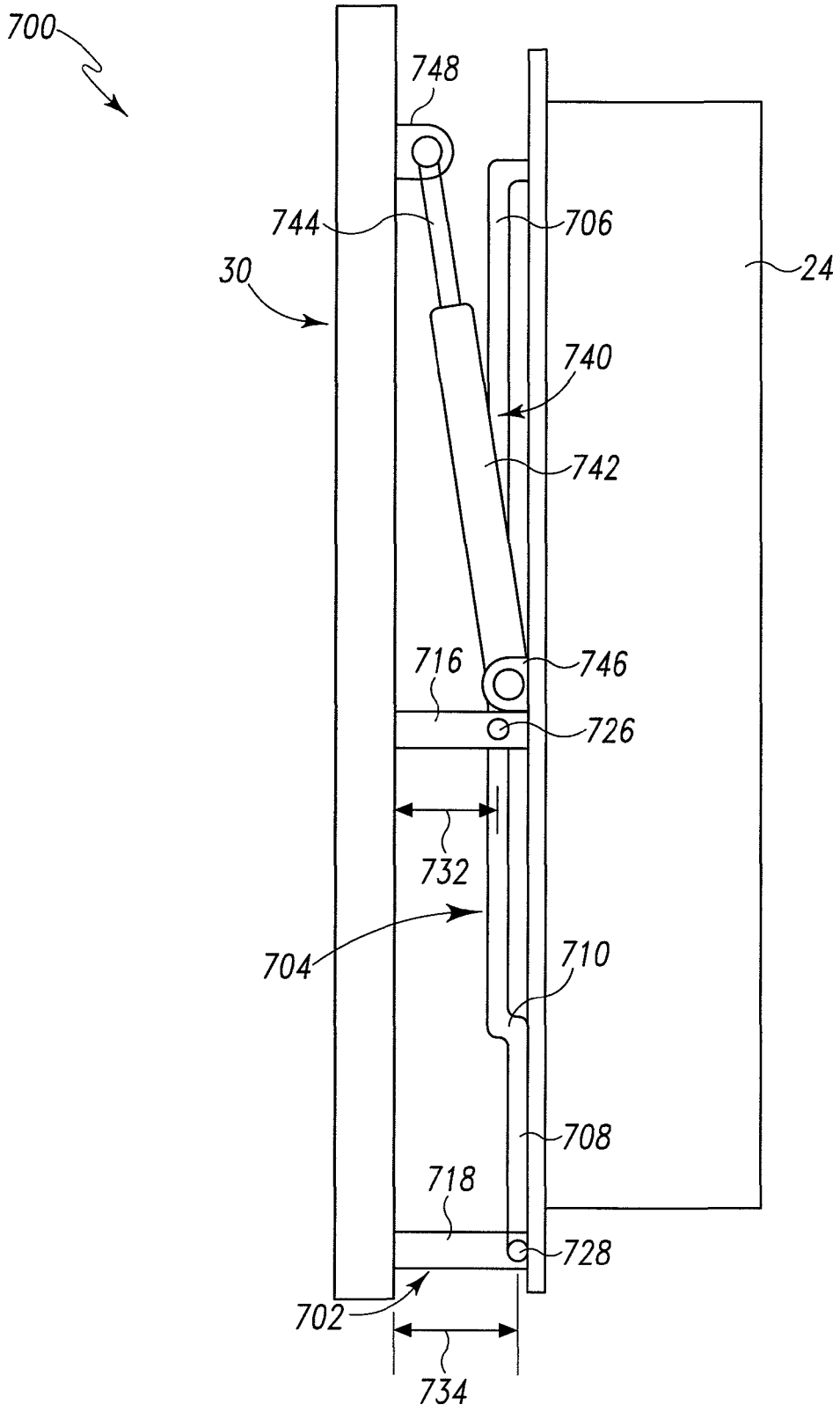
FIG. 16 is a side elevation view of a fifth embodiment of the headwall showing the headwall having a housing, a plurality of service outlets (not shown) coupled to the housing, a cover (such as a picture frame), and a pair of spaced-apart linkages coupled to the housing and coupled to the cover so that the cover is movable between a lowered position in which the cover blocks access to the plurality of service outlets and a raised position in which the cover allows access to the plurality of service outlets, and showing each linkage including a vertically-extending dogleg-shaped guide track coupled to the housing, a pair of laterally-extending pins coupled to the cover and received in the guide tracks, and a gas spring extending between a rearwardly-extending flange coupled to the cover and a forwardly-extending flange coupled to the housing.

FIG. 16 shows a fifth embodiment 700 of the headwall 20 shown in FIGS. 1-6. Like reference numbers will be used to denote similar parts. The headwall 700 includes a pair of laterally-spaced linkages 702 coupled to the housing 24 and coupled to the cover 30 so that the cover 30 is movable between a lowered position in which the cover 30 blocks access to the service outlets 28 and a raised position in which the cover 30 allows access to the service outlets 28. In the illustrated embodiment, each linkage 702 includes a generally vertically-extending dogleg-shaped guide track 704 coupled to the housing 24. Each guide track 704 has an upper portion 706 that is spaced forwardly from the housing 24 a first distance, a lower portion 708 that is spaced forwardly from the housing 24 a second distance smaller than the first distance, and an intermediate portion 710 at the junction of the upper and lower portions 706, 708.

Each linkage 702 has upper and lower flanges 716, 718 that extend rearwardly from the cover 30. Pins or rollers 726, 728 extend laterally outwardly from the respective upper and lower flanges 716, 718 and are received in the guide track 704. When the cover 30 is in the lower closed position shown in FIG. 16, the upper rollers 726 are received in the upper portions 706 of the guide track 704 and the lower rollers 728 are received in the lower portions 708 of the guide track 704. The upper rollers 726 are spaced rearwardly from the cover 30 a first distance 732 and the lower rollers 728 are spaced rearwardly from the cover 30 a second distance 734 greater than the first distance 732. The forward spacing of the upper and lower portions 706, 708 of the guide track 704 from the housing 24 and the rearward spacing of the upper and lower rollers 726, 728 from the cover 30 are such that the cover 30 extends generally parallel to the wall 22 when the cover is in the lowered position shown in FIG. 16.

Each linkage 702 further includes a gas spring 740 that comprises a cylinder 742 and a piston rod 744 that extends out of and retracts into the cylinder 742. In the illustrated embodiment, each cylinder 742 is coupled to a flange 746 that extends forwardly from the housing 24. Each piston rod 744 is coupled to a flange 748 that extends rearwardly from the cover 30. The gas springs 740, like the gas springs 200, provide assisted lift and controlled descent of the cover 30. In the illustrated embodiment, the gas springs 640 are of the type marketed by JWF Technologies as Stabilus® Lift-O-Mat® gas springs. As the cover 30 travels from the lowered closed position to the raised open position, it tilts rearwardly as the lower rollers 728 enter the upper portions 706 of the guide tracks 704 which are spaced forwardly relative to the lower portions 708 of the guide track 704. The cover 30 remains tilted during the rest of its upward travel.

Figure 18:
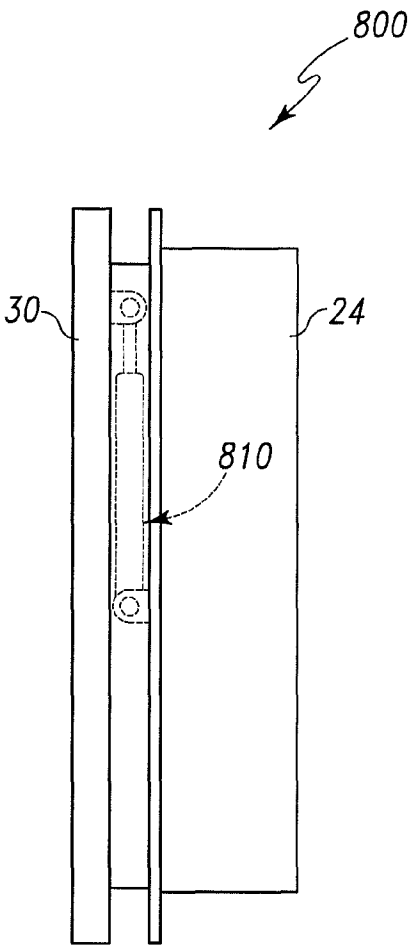
FIG. 18 is a side elevation view of the headwall of FIG. 17.
Figure 17:
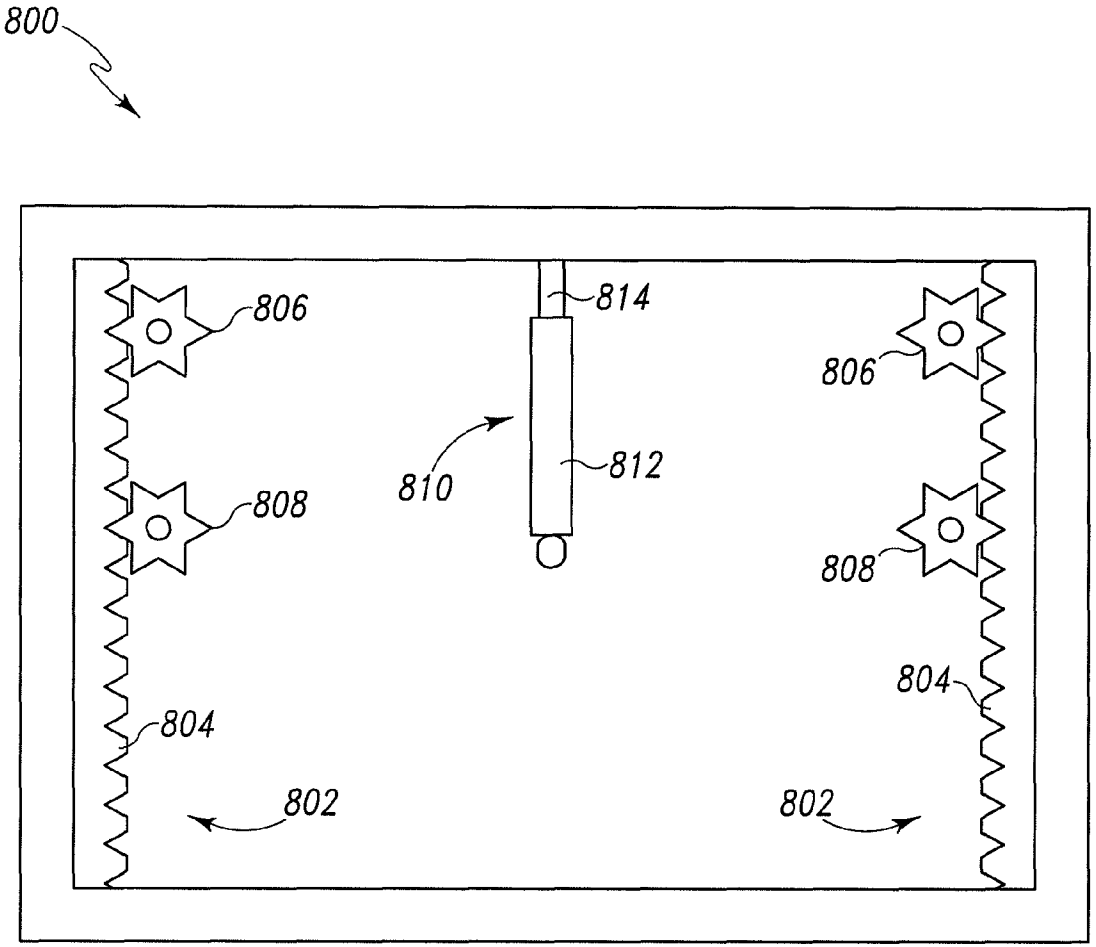
FIG. 17 is a front elevation view of a sixth embodiment of the headwall showing the headwall having a housing, a plurality of service outlets (not shown) coupled to the housing, a cover (such as a picture frame), a pair of spaced-apart linkages coupled to the housing and coupled to the cover so that the cover is movable between a lowered position in which the cover blocks access to the plurality of service outlets and a raised position in which the cover allows access to the plurality of service outlets, and a gas spring extending between a rearwardly-extending flange coupled to the cover and a forwardly-extending flange coupled to the housing, and showing each linkage including a vertically-extending rack coupled to the housing, a pair of pinions rotatably coupled to the cover and engaging the rack.

FIGS. 17-18 shows a sixth embodiment 800 of the headwall 20 shown in FIGS. 1-6. Like reference numbers will be used to denote similar parts. The headwall 800 includes a pair of laterally-spaced linkages 802 coupled to the housing 24 and coupled to the cover 30 so that the cover 30 is movable between a lowered position in which the cover 30 blocks access to the service outlets 28 and a raised position in which the cover 30 allows access to the service outlets 28. In the illustrated embodiment, each linkage 802 includes a generally vertically-extending rack 804 coupled to the housing 24. Each linkage 802 includes upper and lower pinions 806, 808 that are rotatably mounted to the cover 30 and engage the associated track 804. A gas spring 810 has a cylinder 812 coupled to the housing 24 and a piston rod 814 coupled to the cover 30. The gas spring 810, like the gas springs 200, provide assisted lift and controlled descent of the cover 30. In the illustrated embodiment, the gas spring 810 is of the type marketed by JWF Technologies as a Stabilus® Lift-O-Mat® gas spring.

Although certain illustrative embodiments have been described in detail above, variations and modifications exist within the scope and spirit of this disclosure as described and as defined in the following claims.

The invention claimed is:

1. An apparatus for coupling to a wall in a healthcare facility, the apparatus comprising:

a housing having a back wall and a front face, the front face being substantially flush with the wall and having an upper and a lower portion defining a compartment in which at least one service outlet is located a cover, and a linkage including at least one parallelogram linkage having upper and lower support arms with each support arm having a first end pivotably coupled to the front face of the housing and pivotable about a first laterally-extending axis and a second end pivotably coupled to the cover for pivoting movement about a second laterally-extending axis, the linkage having a variable length member pivotably coupled to the housing at a first pivot axis and pivotably coupled to the upper support arm at second pivot axis located at a point on the support arm nearer the first end than the second end, the variable length member biased to extend such that a force is exerted by the variable length member between the housing and the upper support arm, the linkage mounting the cover to the housing for pivoting movement between a first closed position in which the cover blocks access to the at least one service outlet and a second open position in which the cover allows access to the at least one service outlet, the cover remaining substantially vertical as it travels between the closed and open positions.

2. The apparatus of claim 1, wherein the at least one parallelogram linkage includes a frame bracket coupled to the housing, a cover bracket coupled to the cover and each support arm has the first end coupled to the frame bracket for pivoting movement about the first laterally-extending axis and the second end coupled to the cover bracket for pivoting movement about the second laterally-extending axis.

3. The apparatus of claim 1, wherein the at least one parallelogram linkage comprises a pair of laterally-spaced parallelogram linkages.

4. The apparatus of claim 3, wherein the variable length member comprises a gas spring including a cylinder and a piston rod that extends out of and retracts into the cylinder.

5. The apparatus of claim 4, wherein each gas spring has a rating of about 150N force.

6. The apparatus of claim 1, wherein the upper portion defines a compartment through which a service line is routed to the at least one service outlet located in the compartment in the lower portion.

7. The apparatus of claim 3, wherein each frame bracket includes upper and lower flanges that extend forwardly toward the cover, each cover bracket includes upper and lower flanges that extend rearwardly toward the housing, the first end of each upper support arm is pivotably coupled to the upper flange of the associated frame bracket and the second end of each upper support arm is pivotably coupled to the upper flange of the associated cover bracket, and the first end of each lower support arm is pivotably coupled to the lower flange of the associated frame bracket and the second end of each lower support arm is pivotably coupled to the lower flange of the associated cover bracket.

8. The apparatus of claim 1, wherein the cover defines a footprint when projected toward the wall, and the housing lies inside the footprint of the cover when the cover is the closed position blocking access to the at least one service outlet.

9. The apparatus of claim 1, wherein the cover comprises a wall accessory.

10. The apparatus of claim 4, wherein the cylinder is coupled to the upper support arm of the associated parallelogram linkage and the piston rod is coupled to a lower portion of the frame bracket of the associated parallelogram linkage.

11. The apparatus of claim 4, wherein the gas spring is not effective to lift the cover while the cover is positioned at an angle, relative to an axis rearwardly-extending from cover, greater than a predetermined overcenter angle.

12. The apparatus of claim 11, wherein the gas spring is effective to assist lifting the cover while the cover is positioned at an angle, relative to an axis rearwardly-extending from cover, less than the predetermined overcenter angle.

13. The apparatus of claim 12, wherein the overcenter angle is about 270 degrees.

14. The apparatus of claim 3, wherein the linkage further comprises an upper connecting rod rigidly connecting the rear ends of the upper support arms of the pair of laterally-spaced parallelogram linkages.

15. The apparatus of claim 14, wherein the linkage further comprises a lower connecting rod rigidly connecting the rear ends of the lower support arms of the pair of laterally-spaced parallelogram linkages.

16. The apparatus of claim 1, wherein the two first laterally extending axes lie in a first plane and wherein the two second laterally extending axes move from a first side of the first plane to a second side of the first plane as the cover moves between the closed position and the open position.

17. The apparatus of claim 16, wherein the second pivot axis of the variable length member moves from a first side of the first plane to a second side of the first plane as the cover moves between the closed position and the open position.

18. The apparatus of claim 1, wherein the two first laterally extending axes lie in a first plane and wherein the second pivot axis of the variable length member moves from a first side of the first plane to a second side of the first plane as the cover moves between the closed position and the open position.

19. The apparatus of claim 18, wherein the length of the variable length member is reduced during a first portion of the movement of the cover from the closed position to the open position and is expanded during a second portion of the movement from the closed position to the open position.

20. An apparatus for coupling to a wall in a healthcare facility, the apparatus comprising:

a housing having a back wall and a front face, the front face being substantially flush with the wall and having an upper and a lower portion defining a compartment in which at least one service outlet is located a cover, a parallelogram linkage having upper and lower support arms with each support arm having a first end pivotably coupled to the front face of the housing and pivotable about a first laterally-extending axis and a second end pivotably coupled to the cover for pivoting movement about a second laterally-extending axis, and a variable length member pivotably coupled to the housing at a first pivot axis and pivotably coupled to the upper support arm at a second pivot axis located at a point on the support arm nearer the first end than the second end, wherein the two first laterally extending axes lie in a first plane and wherein the second pivot axis of the variable length member moves from a first side of the first plane to a second side of the first plane as the cover moves between the closed position and the open position.

* * * * *